US008128087B2

(12) United States Patent
Choi

(10) Patent No.: US 8,128,087 B2
(45) Date of Patent: Mar. 6, 2012

(54) POWER TRANSMITTER FOR IMAGE FORMING APPARATUS AND AN IMAGE FORMING APPARATUS HAVING THE SAME

(75) Inventor: Dong-ha Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 249 days.

(21) Appl. No.: 11/436,523

(22) Filed: May 19, 2006

(65) Prior Publication Data

US 2006/0291941 A1 Dec. 28, 2006

(30) Foreign Application Priority Data

Jun. 27, 2005 (KR) ..... 10-2005-0055479

(51) Int. Cl.
*B65H 5/00* (2006.01)
*B65H 5/06* (2006.01)

(52) U.S. Cl. ..... 271/264; 271/272

(58) Field of Classification Search ..... 271/272, 271/10.01, 10.09, 264, 109; 74/655
See application file for complete search history.

(56) References Cited

U.S. PATENT DOCUMENTS 5,395,102 A * 3/1995 Eguchi ..... 271/10.04
5,775,685 A * 7/1998 Yamaoka et al. ..... 271/10.13
6,260,844 B1 * 7/2001 Naeser et al. ..... 271/272
6,672,581 B2 1/2004 Lee et al.
6,786,663 B2 * 9/2004 Kawaguchi ..... 400/641
6,789,795 B2 * 9/2004 Kallin et al. ..... 271/272
6,890,114 B2 * 5/2005 Kawaguchi ..... 400/641
6,962,332 B2 * 11/2005 Su ..... 271/4.01
2001/0017439 A1 * 8/2001 Hiramatsu ..... 271/10.11
2004/0081504 A1 * 4/2004 Kawaguchi ..... 400/579
2004/0124575 A1 * 7/2004 Lee et al. ..... 271/10.01
2005/0110205 A1 * 5/2005 Lee et al. ..... 271/4.01
2006/0284362 A1 * 12/2006 Kanome ..... 271/10.01
2007/0001373 A1 * 1/2007 Soo ..... 271/109
2008/0157464 A1 * 7/2008 Bokelman et al. ..... 271/272
2010/0067968 A1 * 3/2010 Mizutani ..... 400/611

FOREIGN PATENT DOCUMENTS

EP 0 622 316 11/1994
JP 2004-264593 9/2004
KR 1991-16543 12/1997
KR 2002-63447 8/2002

* cited by examiner

*Primary Examiner* — Kaitlin Joerger
*Assistant Examiner* — Patrick Cicchino
(74) *Attorney, Agent, or Firm* — Staas & Halsey LLP

(57) ABSTRACT

A power transmitter for an image forming apparatus transmitting power to a plurality of feeding rollers, including a plurality of feeding roller rotation shafts rotatably mounted at certain distances from one another and forming a feeding path of a printing medium by a plurality of feeding rollers which are coaxially mounted therewith; a driving unit rotating one of the plurality of feeding roller rotation shafts; and a feeding gear train mounted on the feeding path of the printing medium to transmit a rotational force of one of the plurality of feeding roller rotation shafts being rotated by the driving unit to the other feeding roller rotation shafts.

17 Claims, 9 Drawing Sheets

POWER TRANSMITTER FOR IMAGE FORMING APPARATUS AND AN IMAGE FORMING APPARATUS HAVING THE SAME

CROSS-REFERENCE TO RELATED APPLICATIONS

This application claims the benefit of Korean Patent Application No. 2005-55479, filed Jun. 27, 2005, in the Korean Intellectual Property Office, the disclosure of which is incorporated herein by reference.

BACKGROUND OF THE INVENTION

1. Field of the Invention

Aspects of the present invention relate to an image forming apparatus. More particularly, aspects of the present invention relate to a power transmitter for delivering power to a plurality of feeding rollers in an image forming apparatus, and an image forming apparatus having the same.

2. Description of the Related Art

Generally, an image forming apparatus performs a printing operation through supplying print media, forming a predetermined image on a print medium, and discharging the print medium whereon the image is formed to the outside.

FIG. 1 is a partial side view schematically showing a conventional image forming apparatus. Referring to FIG. 1, a conventional image forming apparatus 1 comprises a print media supply unit 3, a print media feeding unit 4, and an image formation unit 5.

The print media feeding unit 4, as shown in FIGS. 1 and 2, comprises a plurality of first and second feeding rollers 22 and 26, a power transmitter 20, and a plurality of print media sensors 41 and 42. The plurality of second feeding rollers 26 feed a print medium (not shown) supplied by a pickup roller 11 to the plurality of first feeding rollers 22. The plurality of first feeding rollers 22 feed the print medium being supplied by the plurality of second feeding rollers 26 toward the image formation unit 5.

The power transmitter 20 comprises a first feeding roller rotation shaft 21 for rotating the plurality of first feeding rollers 22, a second feeding roller rotation shaft 25 for rotating the plurality of second feeding rollers 26, a driving motor 29 and a driving gear train 30 for driving the first and the second feeding roller rotation shafts 21 and 25, and a support bracket 37 fixed to a frame 2 of the image forming apparatus 1 supporting the driving motor 29 and the driving gear train 30. A first transmission gear 23 is mounted coaxially with one end of the first feeding roller rotation shaft 21 to receive power from the driving motor 29 through the driving gear train 30. A second transmission gear 27 is mounted coaxially with one end of the second feeding roller rotation shaft 25. The first and the second transmission gears 23 and 27 are meshed with each other. The driving gear train 30 comprises first, second, and third intermediate gears 31, 32 and 33. The third intermediate gear 33 is meshed with the first transmission gear 23.

Additionally, a plurality of first and second feeding idle rollers 24 and 28 are mounted to rotate in contact with the plurality of first and second feeding rollers 22 and 26, respectively.

In FIG. 2, an image formation gear 35 rotates the image formation unit 5 that produces an image on the print medium supplied by the first feeding roller 22, and a fixing gear 36 rotates a fixing unit (not shown) that fixes the image formed on the print medium. In FIG. 3, a pickup gear 13 is coaxially connected to the pickup roller 11.

The plurality of print media sensors 41 and 42 detect a location of the print medium. More particularly, the first print media sensor 41 detects the print medium when the print medium contacts the first feeding roller 22 while the second print media sensor 42 detects the print medium when the print medium contacts the image formation unit 5.

Hereinbelow, the operation of the conventional image forming apparatus will be described with reference to FIGS. 1 and 2.

When a control unit (not shown) receives a printing command, the pickup roller 11 picks up a sheet of the print medium that is stacked in a print media stacking member 12 and feeds the print medium between the second feeding roller 26 and the second feeding idle roller 28. As the driving motor 29 is rotated herein, the first transmission gear 23 is rotated by the driving gear train 30. As the first transmission gear 23 is rotated, the second transmission 27 meshed with the first transmission gear 23 is accordingly rotated. According to a rotation of the first and the second transmission gears 23 and 27, the first and the second feeding roller rotation shafts 21 and 25 coaxially connected with the first and the second transmission gears 23 and 27 are rotated. Then, the first and the second feeding rollers 22 and 26 coaxially connected with the first and the second feeding roller rotation shafts 21 and 25 are rotated. As a result, the first and the second feeding idle rollers 24 and 28 that are in contact with the first and the second feeding rollers 22 and 26 are rotated. Consequently, the print medium fed between the second feeding roller 26 and the second feeding idle roller 28 by the pickup roller 11 is fed to the image formation unit 5 through the second feeding and the second feeding idle rollers 26 and 28, and the first feeding and the first feeding idle rollers 22 and 24. The image formation unit 5 forms an image on the print medium according to the printing command and feeds the print medium bearing thereon the image to the fixing unit (not shown). The fixing unit fixes the image onto the print medium and feeds the print medium to a discharge unit (not shown). As the discharge unit ejects the print medium to the outside of the image forming apparatus 1, the printing work is completed. The control unit appropriately controls the above processes by perceiving the location of the print medium through the first and the second print media sensors 41 and 42.

In the above-structured image forming apparatus 1, the first and the second feeding rollers 22 and 26 for feeding the picked-up print medium to the image formation unit 5 are disposed on the first and the second feeding roller rotation shafts 21 and 25, respectively. Each one end of the first and the second feeding roller rotation shafts 21 and 25 is coaxially connected with the first and the second transmission gears 23 and 27 to receive power through the driving gear train 30 mounted at one end of the image forming apparatus 1. The connection structure between the driving gear train 30 and the first and the second transmission gears 23 and 27 is shown in FIG. 3. Thus, in the conventional image forming apparatus 1, a space having a predetermined height h is required in order for power transmission from the driving motor 29 (FIG. 2) to the first and the second feeding roller rotation shafts 21 and 25 through the driving gear train 30. Generally, the conventional image forming apparatus 1 has a height H of approximately 250~300 mm for the space. The height H includes the predetermined height h required for power transmission to the first and the second feeding roller rotation shafts 21 and 25.

The image forming apparatus 1 is now commonly used domestically, being usually put on a desk at home. However, in this case, a size of the image forming apparatus 1, especially the height H of the image forming apparatus 1, is too high for convenient use. Generally, as the height of the image forming apparatus 1 increases, volume and weight of the image forming apparatus 1 accordingly increase, thereby making handling and portage of the image forming apparatus difficult.

Although there has been much research for reducing the height of the image forming apparatus 1, it is difficult to remarkably reduce the height when the power transmitter for transmitting power to the plurality of feeding rollers is not omitted.

SUMMARY OF THE INVENTION

Aspects of the present invention provide a power transmitter for an image forming apparatus, a mounting height of which is reduced for a compact size of the image forming apparatus, and an image forming apparatus having the same.

Additional aspects and/or advantages of the invention will be set forth in part in the description which follows and, in part, will be obvious from the description, or may be learned by practice of the invention.

According to an aspect of the present invention, there is provided a power transmitter for an image forming apparatus, comprising a plurality of feeding roller rotation shafts rotatably mounted at certain distances from one another and forming a feeding path of a print medium by a plurality of feeding rollers which are coaxially mounted therewith; a driving unit rotating one of the plurality of feeding roller rotation shafts; and a feeding gear train mounted on the feeding path of the print medium to transmit a rotational force of one of the plurality of feeding roller rotation shafts being rotated by the driving unit to the other feeding roller rotation shafts.

The feeding gear train comprises a gear, wherein the gear is coaxially mounted on the plurality of feeding roller rotation shafts and the gear has a smaller outer diameter than the respective feeding rollers mounted to the plurality of feeding roller rotation shafts.

According to another aspect of the present invention, there is provided a power transmitter for an image forming apparatus, comprising a driving unit; a first feeding roller rotation shaft rotated by the driving unit and mounting a plurality of first feeding rollers; a second feeding roller rotation shaft mounting a plurality of second feeding rollers for feeding a print medium to the plurality of first feeding rollers; and a feeding gear train mounted on a feeding path of the print medium being fed from the plurality of second feeding rollers to the plurality of first feeding rollers and transmitting a rotational force of the first feeding roller rotation shaft to the second feeding roller rotation shaft.

The feeding gear train comprises a first feeding gear mounted to the first feeding roller rotation shaft; a second feeding gear mounted to the second feeding roller rotation shaft; and an idle gear interposed between the first and the second feeding gears to transmit the rotational force of the first feeding gear to the second feeding gear.

The first feeding gear and the second feeding gear have smaller outer diameters than the first feeding roller and the second feeding roller, respectively.

The driving unit comprises a driving motor and a driving gear train transmitting power of the driving motor to the first feeding roller rotation shaft.

According to yet another aspect of the present invention, there is provided an image forming apparatus comprising a frame; a feeding path cover mounted to the frame to form a feeding path for a print medium; a first feeding roller rotation shaft mounted within the feeding path cover and rotatably supported by the frame; a plurality of first feeding rollers coaxially connected with the first feeding roller rotation shaft, and an outer circumference of which is partly protruded out of the feeding path cover; a first feeding idle roller mounted at an upper part of the feeding path cover to rotate in contact with the plurality of first feeding rollers; a driving unit mounted in the frame to rotate the first feeding roller rotation shaft; a second feeding roller rotation shaft mounted at an upstream of the first feeding roller rotation shaft within the feeding path cover and rotatably supported by the feeding path cover; a plurality of second feeding rollers coaxially connected with the second feeding roller rotation shaft, and an outer circumference of which is partly protruded out of the feeding path cover; a second feeding idle roller mounted at the upper part of the feeding path cover to rotate in contact with the plurality of second feeding rollers; and a feeding gear train mounted within the feeding path cover to transmit a rotational force of the first feeding roller rotation shaft to the second feeding roller rotation shaft.

The feeding gear train comprises a second feeding gear coaxially connected with the second feeding roller rotation shaft; an idle gear mounted within the feeding path cover to rotate in mesh with the second feeding gear; and a first feeding gear meshed with the idle gear and coaxially connected with the first feeding roller rotation shaft.

The idle gear is engaged with a snap-connection shaft formed inside the feeding path cover.

The second feeding gear is mounted at one end of the second feeding roller rotation shaft.

According to the above power transmitter of an image forming apparatus and the image forming apparatus having the same, since the feeding gear train is provided on the feeding path of the print medium, a height of the image forming apparatus can be decreased. As the height of the image forming apparatus is thus decreased, handling and portage of the image forming apparatus becomes easier, also reducing material cost.

Furthermore, in the above power transmitter and the image forming apparatus having the same, the idle rollers are mounted through snap-fit connection, thereby reducing assembling and material costs.

In addition, the image forming apparatus according to the present invention is convenient especially for personal use, such as in a narrow space, due to its decreased height.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
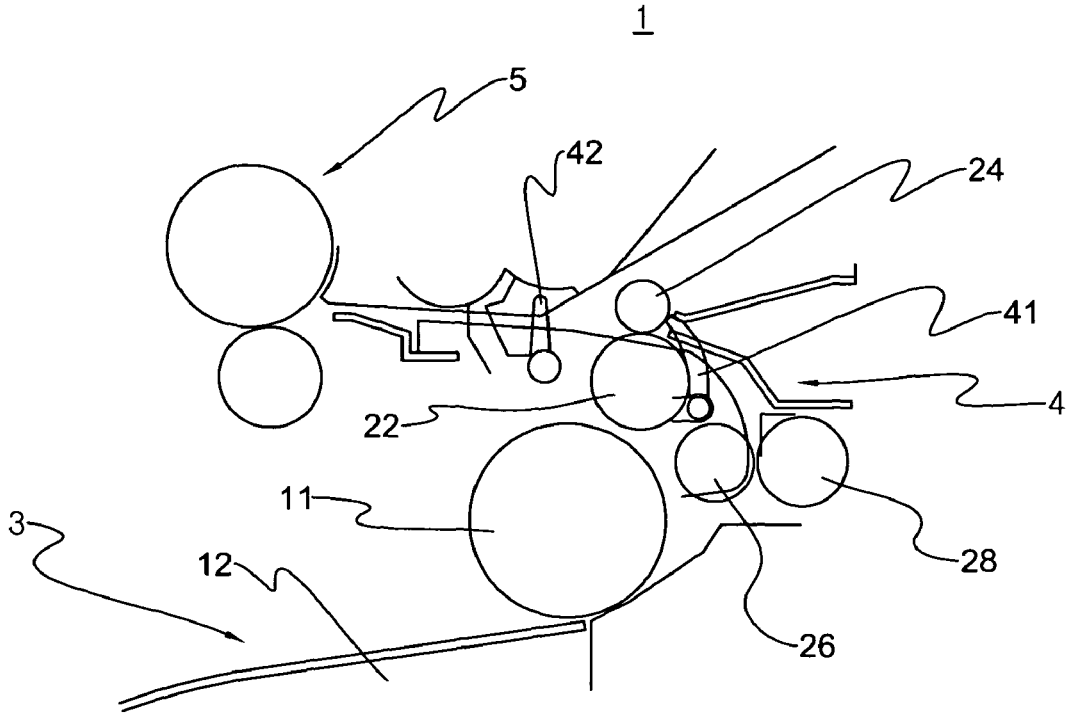
FIG. 1 (PRIOR ART)
FIG. 1 is a partial side view schematically showing a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
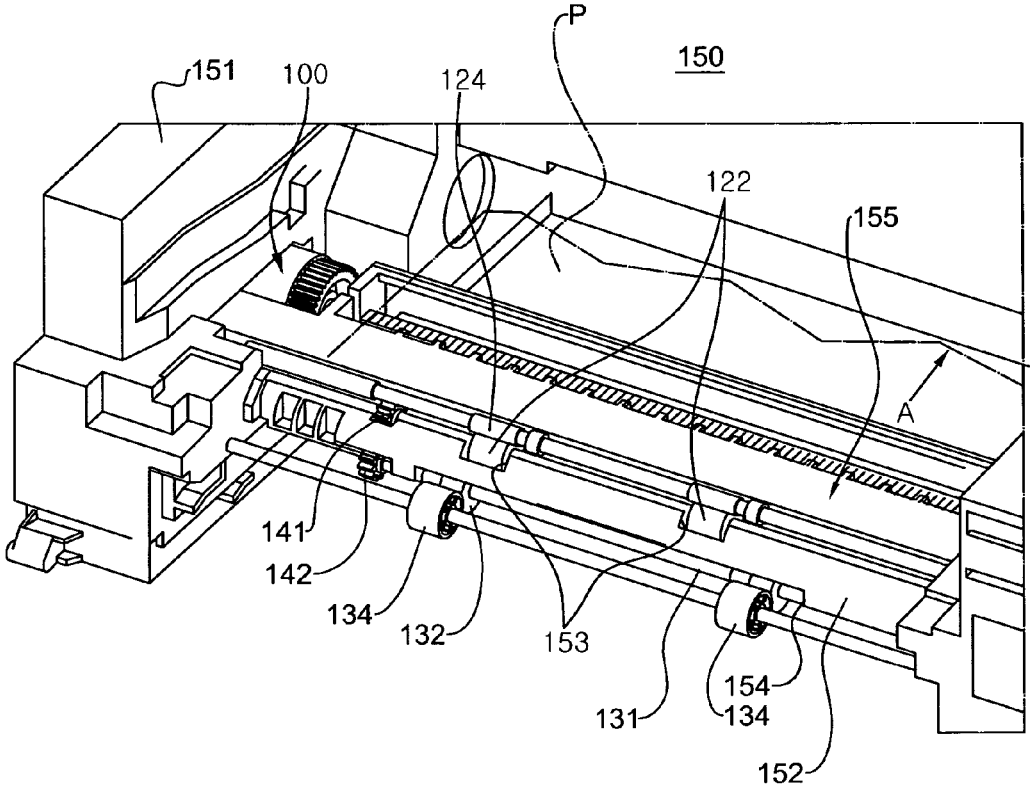
FIG. 4 is a partial perspective view showing an image forming apparatus according to an embodiment of the present invention.

Referring to FIG. 4, an image forming apparatus 150 according to an embodiment of the present invention comprises a print media supply unit (not shown), a print media feeding unit 155, an image formation unit (not shown), and a discharge unit (not shown). In FIG. 4, however, the print media supply unit, the image formation unit, and the discharge unit are omitted for clear illustration, and only the print media feeding unit 155 is partially illustrated. Also, well-known functions or constructions are not described in detail since they would obscure the invention in unnecessary detail.

Referring to FIG. 4, the print media feeding unit 155 of the image forming apparatus 150 according to an embodiment of the present invention comprises a frame 151, a feeding path cover 152, a plurality of first feeding rollers 122, a first feeding idle roller 124, a plurality of second feeding rollers 132, a second feeding idle roller 134, and a power transmitter 100.

The frame 151 constitutes a main body of the image forming apparatus 150 and supports the print media supply unit (not shown), the image formation unit (not shown), the discharge unit (not shown), and the other component parts that will be described hereinafter.

The feeding path cover 152, being mounted to the frame 151, forms a feeding path for guiding feeding of a print medium P from the print media supply unit to the image formation unit.

Other types of print media P aside from paper, such as transparencies, overheads, etc., may be used.

Outer circumferences of the plurality of first and second feeding rollers 122 and 132 are partly protruded on a front of the feeding path cover 152. For this, a plurality of holes or cut portions 153 and 154 are formed at the feeding path cover 152 so that the first and the second feeding rollers 122 and 132 can be partly protruded therethrough. The first feeding roller 122 is disposed at a downstream of the second feeding roller 132 with respect to a feeding direction A of the print medium P.

Being supported by the frame 151, the first feeding idle roller 124 is rotated in contact with the plurality of first feeding rollers 122 at an upper part of the feeding path cover 152. The second feeding idle roller 134 is supported by the frame 151 to rotate in contact with the plurality of second feeding rollers 134 at the upper part of the feeding path cover 152.

Figure 5:
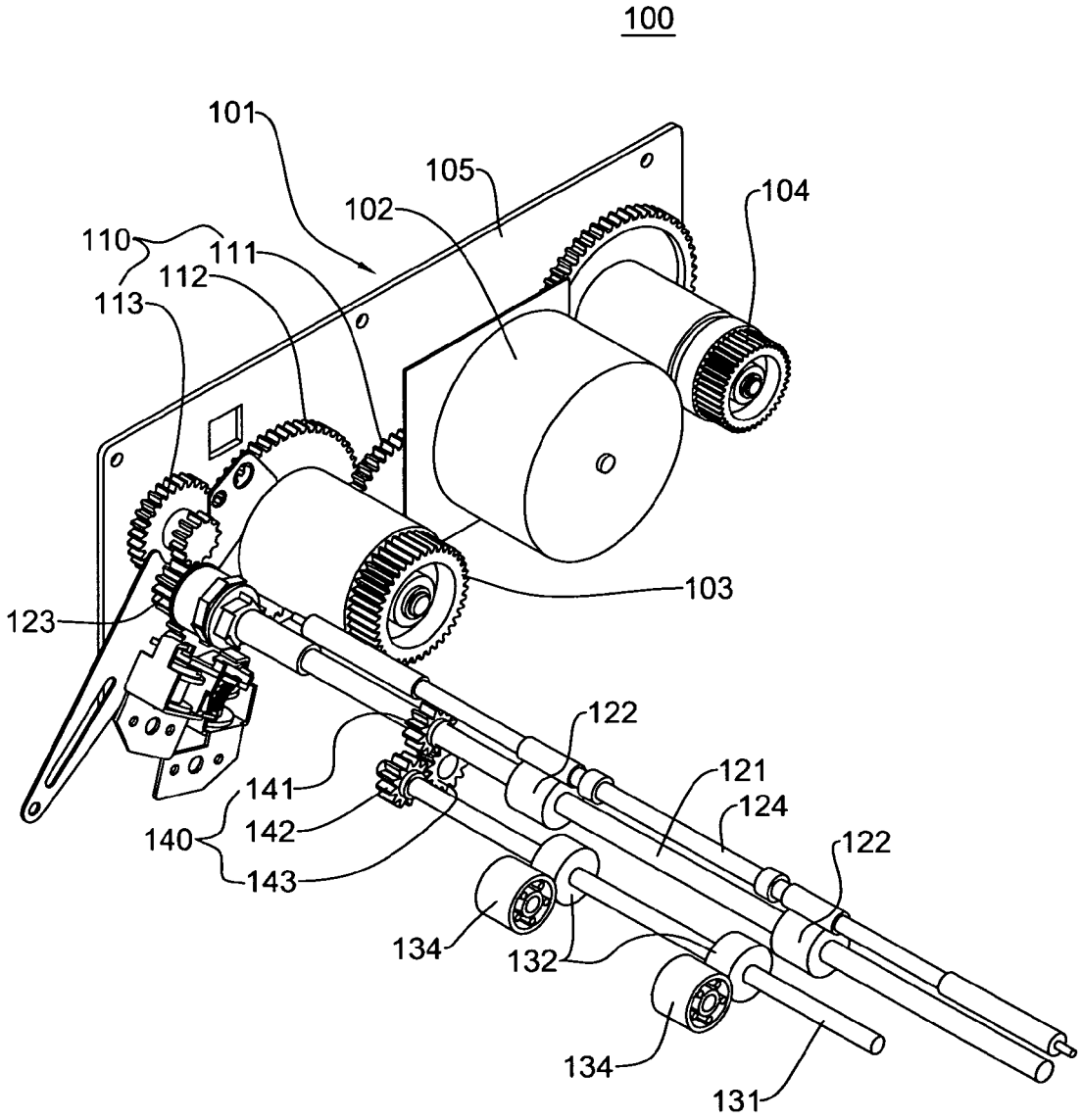
FIG. 5 is a perspective view showing a power transmitter for use in the image forming apparatus of FIG. 4.
Figure 6:
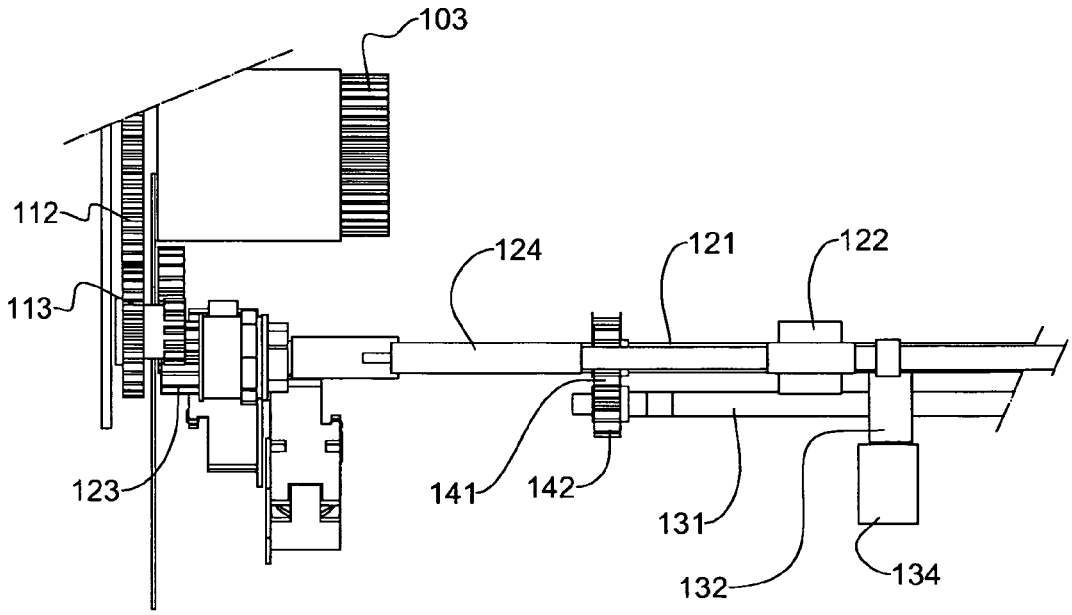
FIG. 6 is a plan view of the power transmitter for use in the image forming apparatus of FIG. 5.
Figure 7:
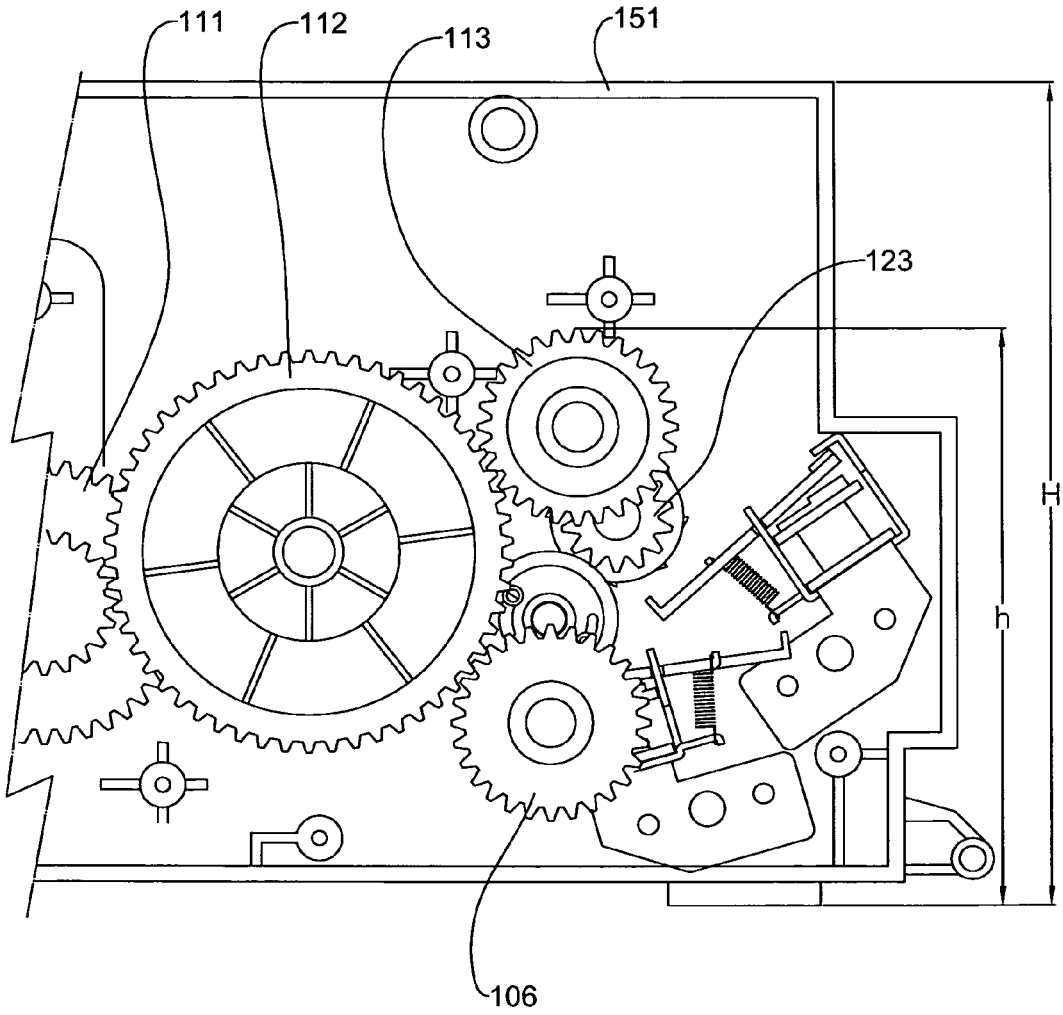
FIG. 7 is a side view of the power transmitter for use in the image forming apparatus of FIG. 5.

The power transmitter 100 rotates the plurality of first and the second feeding rollers 122 and 132. Referring to FIGS. 5 through 7, the power transmitter 100 comprises a driving unit 101, a first feeding roller rotation shaft 121, a second feeding roller rotation shaft 131, and a feeding gear train 140.

The driving unit 101 comprises a driving motor 102 and a driving gear train 110. The driving gear train 110 transmits power from the driving motor 102 to one of the first and the second feeding roller rotation shafts 121 and 131. Although not shown, in case of an image forming apparatus wherein the feeding path for the print medium is formed by three or more feeding roller rotation shafts rotatably mounted at certain distances from one another, to which a plurality of feeding rollers are coaxially mounted, the driving gear train is structured to transmit the power to one of the three or more feeding roller rotation shafts. In this embodiment, the driving gear train 110 is mounted within the frame 151 to transmit the power of the driving motor 102 to the first feeding roller rotation shaft 121. For the power transmission, the driving gear train 110 comprises first, second, and third intermediate gears 111, 112, and 113. Further, the driving unit 101 comprises an image formation gear 103 and a fixing gear 104 for transmitting the power to an image formation unit (not shown) and a fixing unit (not shown). The driving unit 101 further comprises a fixing bracket 105 for fixing and supporting the driving motor 102, the driving gear train 110, and the fixing gear 104 to the frame 151.

The first feeding roller rotation shaft 121 is mounted inside the feeding path cover 152 and rotatably supported by the frame 151. To one end of the first feeding roller rotation shaft 121, a transmission gear 123 meshed with the third intermediate gear 113 of the driving gear 110 is coaxially mounted to rotate integrally. Therefore, the one end of the first feeding roller rotation shaft 121 is extended to a part of the frame 151 where the driving gear train 110 is mounted. The plurality of first feeding rollers 122 are coaxially connected and integrally rotated with the first feeding roller rotation shaft 121. In addition, a first feeding gear 141 of the feeding gear train 140 that will be described hereinafter is mounted between the transmission gear 123 and the first feeding roller 122 to rotate coaxially and integrally with the transmission gear 123 and the first feeding roller 122. However, such an arrangement of the first feeding gear 141 is only by way of example. The first feeding gear 141 can be mounted at any part of the first feeding roller rotation shaft 121 as long as it is disposed under the zone of the print medium being fed by the first feeding roller 122.

The second feeding roller rotation shaft 131 is disposed at an upstream of the first feeding roller rotation shaft 121 inside the feeding path cover 152 and rotatably supported by the feeding path cover 152. The upstream herein is determined based on the feeding direction of the print medium P. A shaft supporting bracket 157 (FIG. 8A) is provided in the feeding path cover 152 to support a rotation of the second feeding roller rotation shaft 131. Therefore, the second feeding roller rotation shaft 131 is shorter than the first feeding roller rotation shaft 121. Meanwhile, the plurality of second feeding rollers 132 are coaxially connected and integrally rotated with the second feeding roller rotation shaft 131. Additionally, the second feeding roller rotation shaft 131 is provided with a second feeding gear 142 at a position corresponding to the first feeding gear 141 mounted to the first feeding roller rotation shaft 121. The second feeding gear 142 is transmitted with the power of the driving motor 102 through the first feeding gear 141.

The feeding gear train 140 is mounted on the feeding path formed by the plurality of feeding rollers 122 and 132. The feeding gear train 140 is configured so that one of the feeding roller rotation shafts 121, transmitted with the power through the driving gear train 110 of the driving unit 101, transmits the power to the other feeding roller rotation shaft 131. When transmitting the power, the driving gear train 140 rotates the plurality of feeding roller rotation shafts 121 and 131 all in the same direction. Therefore, the number of gears constituting the feeding gear train 140 is determined by the number of the feeding roller rotation shafts.

The power transmitter 100 of the image forming apparatus according to an embodiment of the present invention comprises first and second feeding roller rotation shafts 121 and 131. The feeding gear train 140 of the power transmitter 100 comprises the first feeding gear 141, the second feeding gear 142, and an idle gear 143. The feeding gear train 140, disposed inside the feeding path cover 152, transmits rotation of the first feeding roller rotation shaft 121 to the second feeding roller rotation shaft 131.

The first feeding gear 141 is coaxially connected with the first feeding roller rotation shaft 121. Here, as aforementioned, the first feeding gear 141 is disposed at the zone corresponding to the feeding path of the print medium P. In this embodiment, the first feeding gear 141 is mounted to the first feeding roller rotation shaft 121 between the first feeding roller 122 and the transmission gear 123.

Figure 8A:
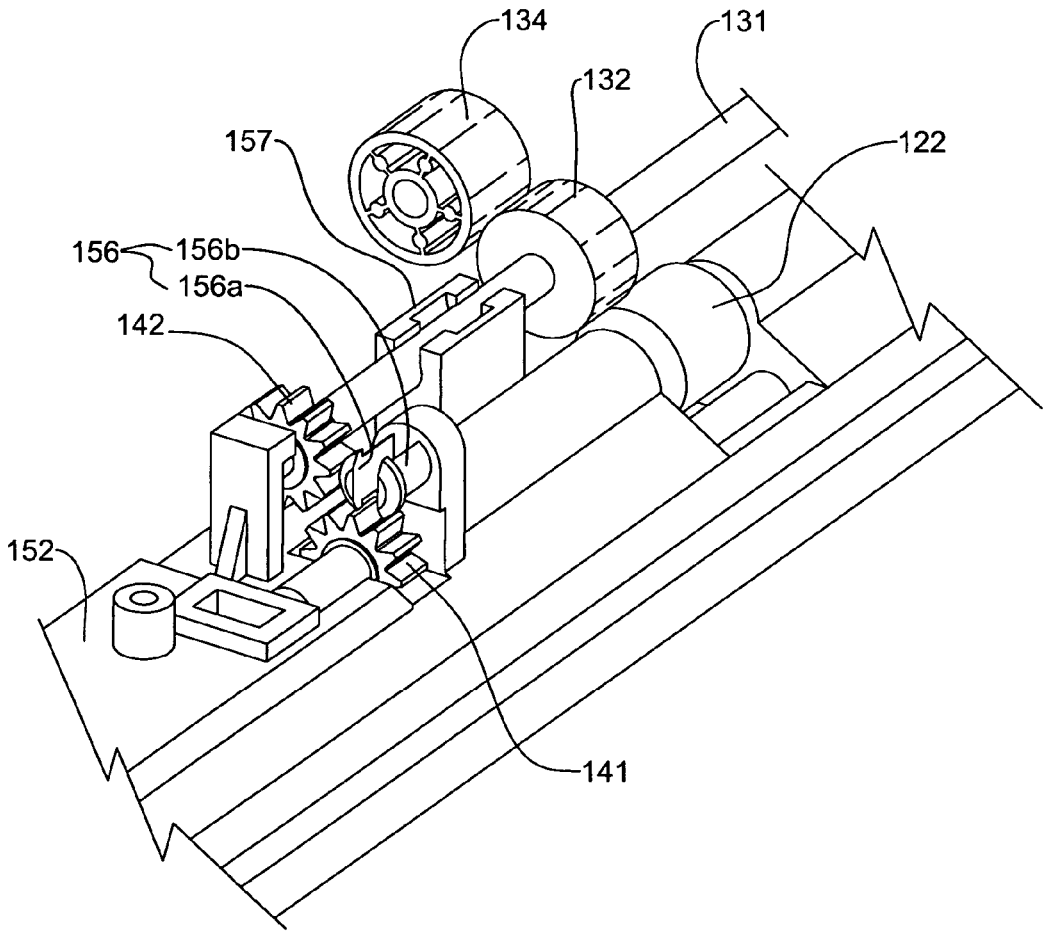
FIGS. 8A and 8B are partial perspective views showing states of an idle gear of a feeding gear train of FIG. 4, of before and after being connected to a lower part of a feeding path cover, respectively.
Figure 8B:
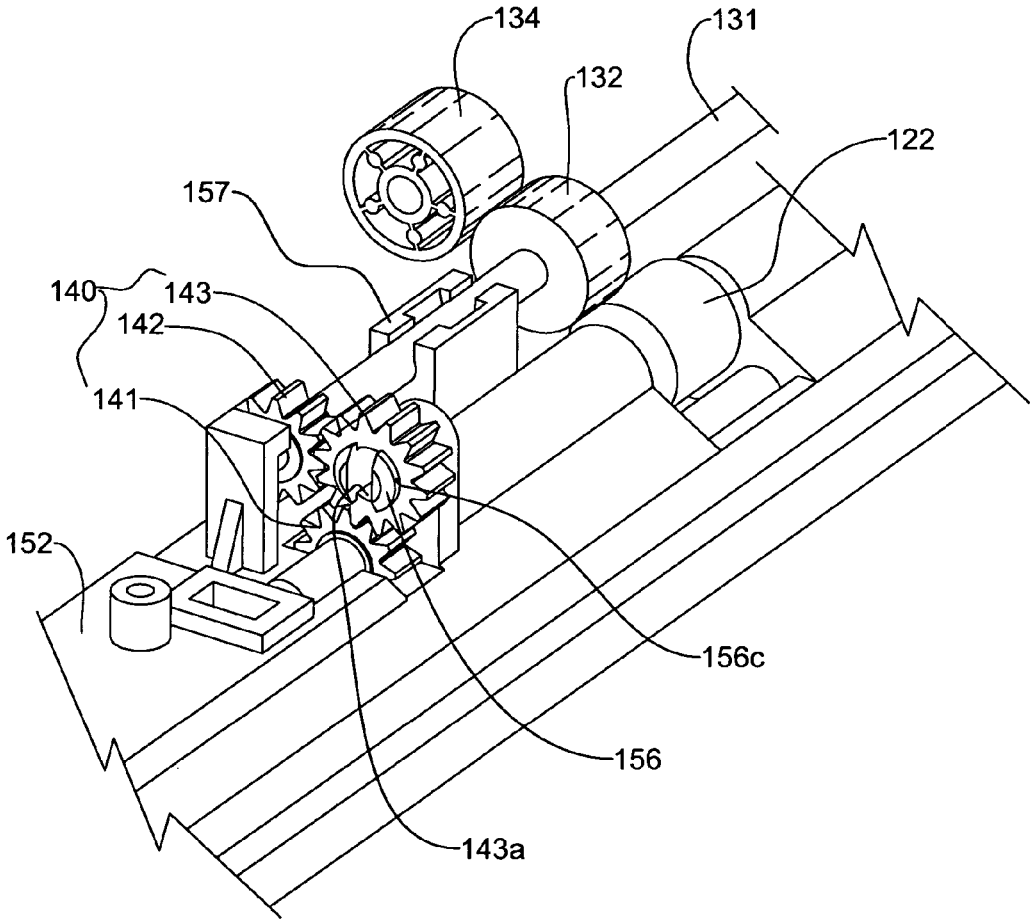

The idle gear 143 rotates in mesh with the first feeding gear 141. Here, the idle gear 143 is disposed so as to not be interfered with the print medium P being fed. The idle gear 143 is mounted within the feeding path cover 152. More specifically, the idle gear 143 can be rotatably mounted in the feeding path cover 152 using a dedicated shaft and fastening member. However, according to the present embodiment, as shown in FIG. 8A, a snap-connection shaft 156 is integrally formed with the feeding path cover 152 so that the idle gear 143 can be connected with the snap-connection shaft 156 by snap-fit without a dedicated fastening member. In greater detail, a shaft hole 143*a* of the idle gear 143 is accorded to an end of the snap-connection shaft 156 and then the idle gear 143 is pushed in. Accordingly, as two branches 156*a* and 156*b* constituting the snap-connection shaft 156 are closed up, the idle gear 143 can be engaged with the snap-connection shaft 156. FIG. 8B shows the idle gear 143 as engaged with the snap-connection shaft 156. A protruded rim 156*c* of the snap-connection shaft 156 prevents separation of the idle gear 143 from the snap-connection shaft 156.

The second feeding gear 142 is coaxially connected to the second feeding roller rotation shaft 131 to rotate in mesh with the idle gear 143.

To avoid interference between the print medium P being fed to the feeding path cover 152 and the feeding gear train 140, the first feeding gear 141 is configured to have a smaller outer diameter than the first feeding roller 122, and the second feeding gear 142 is configured to have a smaller outer diameter than the second feeding roller 132.

Figure 2:
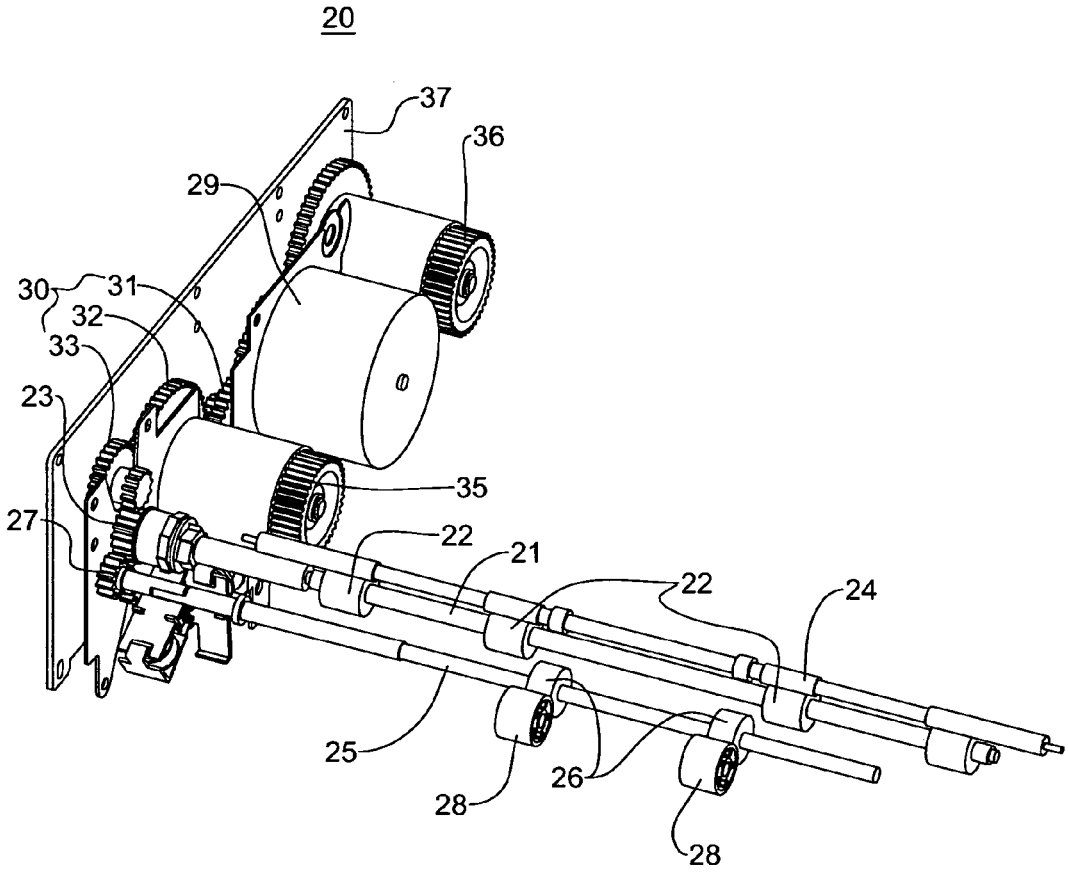
FIG. 2 (PRIOR ART)
FIG. 2 is a perspective view showing a power transmitter of the conventional image forming apparatus.
Figure 3:
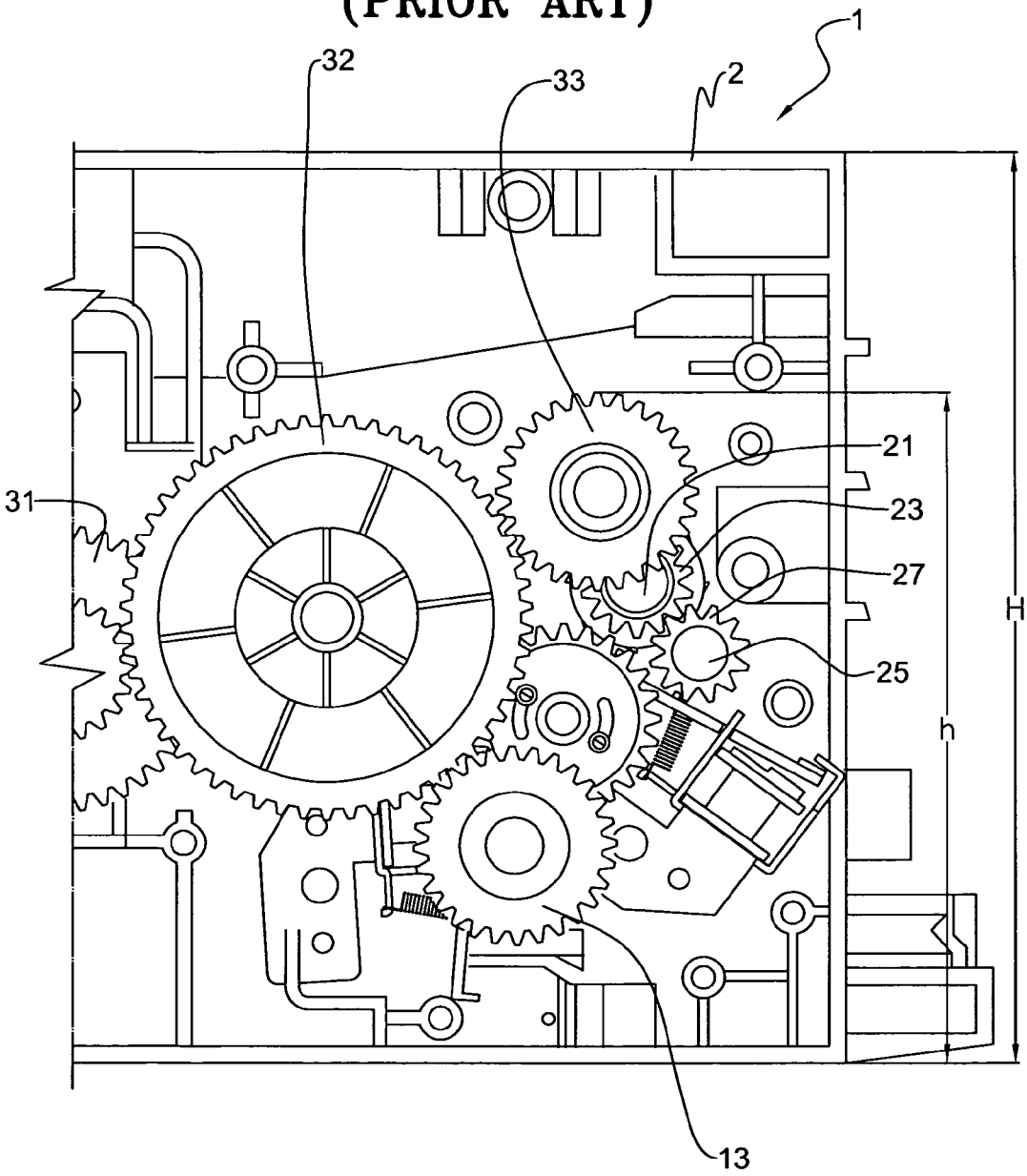
FIG. 3 (PRIOR ART)
FIG. 3 is a partial side view of the conventional image forming apparatus.

In the image forming apparatus 150 according to an embodiment of the present invention, the feeding gear train 140 is disposed in a space for feeding the print medium P, thereby saving the space required for power transmission to the second feeding roller 132. In other words, since the driving gear train 110 of the driving unit 101 transmits the power only to the transmission gear 123, a height h (FIG. 7) of the space required for power transmission from the driving gear train 110 to the transmission gear 123 is decreased in comparison with the conventional driving gear train 30 (FIG. 2) in which the power is transmitted to two transmission gears 23 and 27 (FIG. 2). As a result, a height H (FIG. 7) of the image forming apparatus 150 can be reduced by approximately 30~40 mm, compared to the conventional image forming apparatus 1.

Hereinbelow, the operation of the above-structured image forming apparatus 150 will be described in greater detail with reference to FIGS. 4 through 6.

Upon receiving a printing command, a control unit (not shown) operates the driving motor 102 and accordingly, a pickup roller (not shown) picks up a sheet of the print medium P stacked in a print media stacking member (not shown) and feeds the print medium P to the second feeding roller 132. The pickup roller herein is transmitted with the power through a pickup gear 106 (FIG. 7) that is coaxially mounted therewith.

Upon operation of the driving motor 102, the transmission gear 123 meshed with the third intermediate gear 113 is rotated through the first, second, and third intermediate gears 111, 112, and 113. Upon rotation of the transmission gear 123, the first feeding roller rotation shaft 121 coaxially connected with the transmission gear 123 is rotated. As the first feeding roller second feeding gear 142 meshed with the idle gear 143 is rotated. Next, the second feeding roller rotation shaft 131 integrally connected with the second feeding gear 142 is rotated.

When the first and the second feeding roller rotation shafts 121 and 131 are rotated through the above processes, the plurality of first and the second feeding rollers 122 and 132 which are coaxially connected to the first and the second feeding roller rotation shafts 121 and 131 are integrally rotated. According to the rotation of the first and the second feeding rollers 122 and 132, the first and the second feeding idle rollers 124 and 134 that are in contact with the first and the second feeding rollers 122 and 132, respectively, are rotated.

Therefore, the print medium P being fed by the pickup roller between the second feeding roller 132 and the second feeding idle roller 134 is fed between the first feeding roller 122 and the first feeding idle roller 124. Because the first feeding roller 122 and the first feeding idle roller 124 are being rotated at this time, the print medium P being fed to the first feeding roller 122 and the first feeding idle roller 124 by the second feeding roller 132 is fed to the image formation unit (not shown) by the first feeding roller 122 and the first feeding idle roller 124.

The image formation unit produces an image corresponding to the received printing data on the print medium P. The print medium P whereon the image is formed is fed to the fixing unit (not shown), and the fixing unit fixes the image on the print medium P. The print medium P bearing the fixed image is discharged to the outside of the image forming apparatus 150 through the discharge unit.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A power transmitter of an image forming apparatus having an image forming unit, the power transmitter comprising:

a plurality of feeding roller rotation shafts rotatably mounted at certain distances from one another and forming a feeding path of a print medium by a plurality of feeding rollers which are coaxially mounted therewith and feed the printing medium toward the image forming unit;

a plurality of feeding idle rollers mounted at an upper part of the feeding path to rotate in contact with the plurality of feeding rollers;

a driving unit comprising a driving motor and a driving gear train, the driving gear train transmitting power directly from the driving motor to only one of the plurality of feeding roller rotation shafts; and a feeding gear train disposed below a part of the feeding roller rotation shaft receiving power from the driving motor between the driving gear train and the feeding roller thereof to transmit a rotational force of the one of the plurality of feeding roller rotation shafts being rotated by the driving unit to another feeding roller rotation shaft, wherein the feeding gear train is located between the plurality of feeding rollers and the driving gear train in a direction orthogonal to the sheet feeding direction at a point closer to the plurality of feeding rollers.

2. The power transmitter as claimed in claim 1, wherein the feeding gear train comprises two or more feeding gears, each coaxially mounted with a respective one of the plurality of feeding roller rotation shafts, wherein the feeding gears have a smaller outer diameter than the respective feeding rollers mounted to the plurality of feeding roller rotation shafts.

3. The power transmitter as claimed in claim 2, wherein the feeding gear train comprises one or more idle gears, wherein each of the idle gears is interposed between two of the feeding gears to transmit the rotational force of one of the feeding gears to an other one of the feeding gears.

4. The power transmitter as claimed in claim 3, wherein the idle gear is interposed between a first one of the feeding gears and a second one of the feeding gears, and transmits the rotational force of the first feeding gear to the second feeding gear.

5. The power transmitter as claimed in claim 3, further comprising a feeding path cover to form the feeding path of the print medium.

6. The power transmitter as claimed in claim 5, wherein the feeding path cover comprises a snap-connection shaft engaging the idle gear and accommodated on an inside surface.

7. The power transmitter as claimed in claim 5, wherein the feeding path cover comprises a plurality of holes, through which outer circumferences of the plurality of feeding rollers are protruded.

8. A power transmitter of an image forming apparatus having an image forming unit, the power transmitter comprising:

a driving unit comprising a driving motor and a driving gear train;

a first feeding roller rotation shaft rotated by the driving unit and mounting a first plurality of the feeding rollers which feed a printing medium toward the image forming unit, the driving gear train transmitting power from the driving motor directly to the first feeding roller rotation shaft;

a second feeding roller rotation shaft mounting a second plurality of the feeding rollers to feed a print medium to the first plurality of the feeding rollers; and a feeding gear train disposed below a part of the first feeding roller rotation shaft receiving power from the driving motor between the driving gear train and the first plurality of feeding rollers thereof and transmitting a rotational force of the first feeding roller rotation shaft to the second feeding roller rotation shaft, wherein the feeding gear train is located between the plurality of feeding rollers and the driving gear train in a direction orthogonal to the sheet feeding direction at a point closer to the plurality of feeding rollers, and wherein a first feeding idle roller is mounted at an upper part of the feeding path to rotate in contact with the first plurality of the feeding rollers and a second feeding idle roller is mounted at the upper part of the feeding path to rotate in contact with the second plurality of the feeding rollers.

9. The power transmitter as claimed in claim 8, wherein the feeding gear train comprises:

a first feeding gear coaxially mounted to the first feeding roller rotation shaft;

a second feeding gear coaxially mounted to the second feeding roller rotation shaft; and an idle gear interposed between the first and the second feeding gears to transmit the rotational force of the first feeding gear to the second feeding gear.

10. The power transmitter as claimed in claim 9, wherein the first feeding gear and the second feeding gear have smaller outer diameters than the first plurality of the feeding rollers and the second plurality of the feeding rollers, respectively.

11. The power transmitter as claimed in claim 9, wherein the second feeding gear is mounted at one end of the second feeding roller rotation shaft.

12. An image forming apparatus having an image forming unit comprising:

a frame;

a feeding path cover mounted to the frame to form a feeding path of a print medium to the image forming unit;

a first feeding roller rotation shaft mounted within the feeding path cover and rotatably supported by the frame;

a first plurality of the feeding rollers coaxially connected with the first feeding roller rotation shaft;

a first feeding idle roller mounted at an upper part of the feeding path cover to rotate in contact with the first plurality of the feeding rollers;

a driving unit comprising a driving motor and a driving gear train, the driving unit being mounted in the frame, the driving gear train transmitting power directly from the driving motor to only the first feeding roller rotation shaft;

a second feeding roller rotation shaft mounted at an upstream of the first feeding roller rotation shaft within the feeding path cover and rotatably supported by the feeding path cover;

a second plurality of the feeding rollers coaxially connected with the second feeding roller rotation shaft;

a second feeding idle roller mounted at the upper part of the feeding path cover to rotate in contact with the second plurality of the feeding rollers; and a feeding gear train disposed below a part of the first feeding roller rotation shaft receiving power from the driving motor between the driving gear train and the first plurality of feeding rollers thereof within the feeding path cover to transmit a rotational force of the first feeding roller rotation shaft to the second feeding roller rotation shaft, wherein the feeding gear train is located between the plurality of feeding rollers and the driving gear train in a direction orthogonal to the sheet feeding direction at a point closer to the plurality of feeding rollers.

13. The image forming apparatus as claimed in claim 12, wherein the feeding path cover comprises a plurality of holes, through which outer circumferences of the first plurality of the feeding rollers and outer circumferences of the second plurality of the feeding rollers are protruded.

14. The image forming apparatus as claimed in claim 12, wherein the feeding gear train comprises:

a first feeding gear coaxially mounted with the first feeding roller rotation shaft;

a second feeding gear coaxially mounted with the second feeding roller rotation shaft; and an idle gear mounted within the feeding path cover to rotate in mesh with the first feeding gear and the second feeding gear and transmitting the rotational force of the first feeding gear to the second feeding gear.

15. The image forming apparatus as claimed in claim 14, wherein the first feeding gear and the second feeding gear have smaller outer diameters than the first plurality of the feeding rollers and the second plurality of the feeding rollers, respectively.

16. The image forming apparatus as claimed in claim 14, wherein the feeding path cover comprises a snap-connection shaft engaging the idle gear and accommodated on an inside surface.

17. The image forming apparatus as claimed in claim 14, wherein the second feeding gear is mounted at one end of the second feeding roller rotation shaft.

* * * * *

UNITED STATES PATENT AND TRADEMARK OFFICE

CERTIFICATE OF CORRECTION

PATENT NO. : 8,128,087 B2
APPLICATION NO. : 11/436523
DATED : March 6, 2012
INVENTOR(S) : Dong-ha Choi It is certified that error appears in the above-identified patent and that said Letters Patent is hereby corrected as shown below:

Column 9, Line 18, In Claim 3, delete “an other” and insert -- another --, therefor.

Signed and Sealed this
Twenty-ninth Day of May, 2012

David J. Kappos

David J. Kappos
*Director of the United States Patent and Trademark Office*